United States Patent [19]

Poliak et al.

[11] Patent Number: 4,634,211

[45] Date of Patent: Jan. 6, 1987

[54] WIRING DEVICE SYSTEM WITH SINGLE SCREW SUBASSEMBLY

[75] Inventors: John M. Poliak, East Meadow; Juan M. Lopez, Jamaica; Robert W. Gritz, Little Neck, all of N.Y.

[73] Assignee: Leviton Manufacturing Company, Inc., Little Neck, N.Y.

[21] Appl. No.: 430,631

[22] Filed: Sep. 30, 1982

[51] Int. Cl.[4] ..... H01R 33/72

[52] U.S. Cl. ..... 339/196 M; 339/196 A; 339/174; 339/270 R

[58] Field of Search ..... 339/196 R, 196 M, 196 A, 339/174, 263 R, 208, 270 R, 206 P

[56] References Cited

U.S. PATENT DOCUMENTS

| | | | |
|---|---|---|---|
| 2,815,495 | 12/1957 | Webster | 339/174 |
| 3,594,709 | 7/1971 | Woertz | 339/196 R |
| 3,829,819 | 8/1974 | Eckart | 339/206 P |
| 3,891,297 | 6/1975 | Poliak et al. | 339/270 R |
| 4,004,846 | 1/1977 | Woertz | 339/263 R |

FOREIGN PATENT DOCUMENTS

| | | | |
|---|---|---|---|
| 1189891 | 4/1970 | United Kingdom | 339/263 R |

*Primary Examiner*—Gil Weidenfeld
*Assistant Examiner*—Thomas M. Kline
*Attorney, Agent, or Firm*—Paul J. Sutton

[57] ABSTRACT

The present invention teaches a novel device that electrically connects conductors from a cable to the electrical contacts of a plug or receptacle by means of a single fastener. The device comprises a shell, and an assembly carried by the shell. The assembly is capable of mating engagement with other electrical contacts and has receiving means for receiving electrical conductors. A single fastener holds the terminals of the conductors in electrical connection with the electrical contacts. The single fastener includes a movable carriage on which is mounted a nut through which a screw is threaded with a head with a flange that is engaged with the wall of the assembly so that when the screw is rotated, the carriage moves so as to decrease or enlarge a chamber in which the conductor terminals and a portion of the electrical contacts are situated.

12 Claims, 26 Drawing Figures

FIG. 10
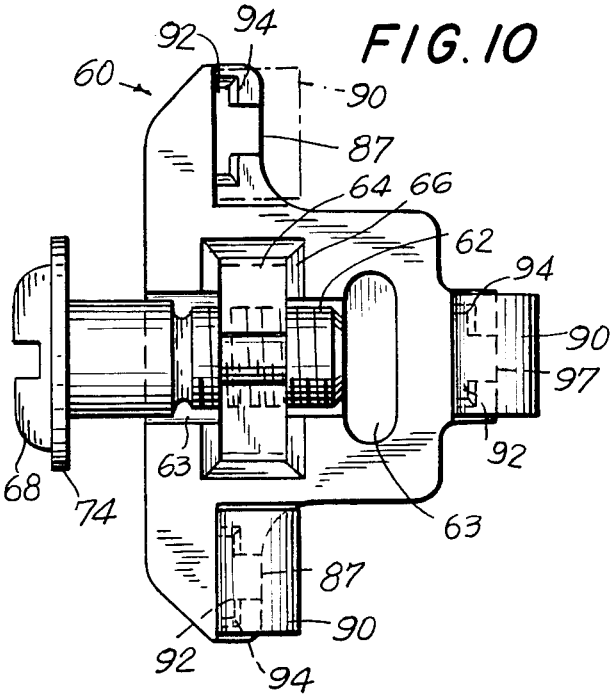
FIG. 11
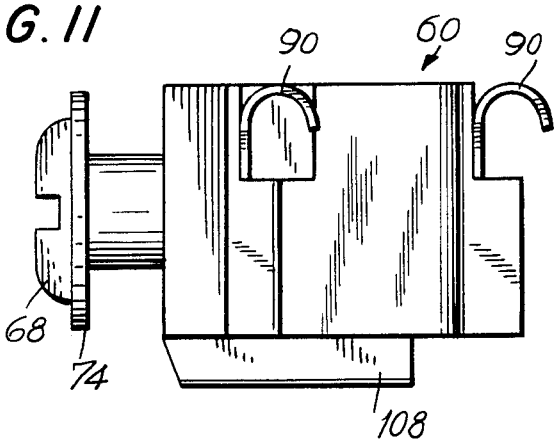
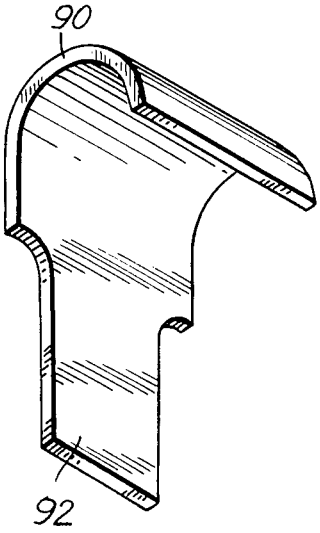
FIG. 13
FIG. 12
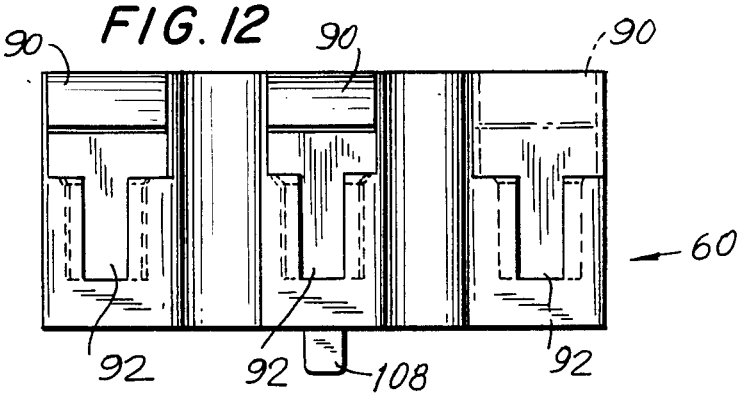

FIG. 20
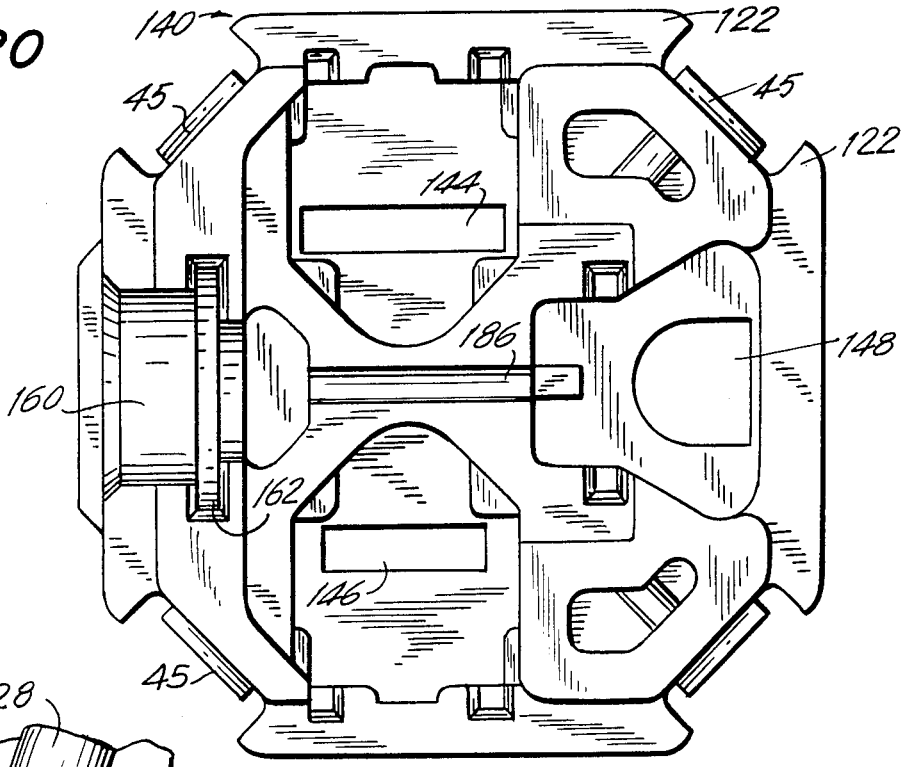
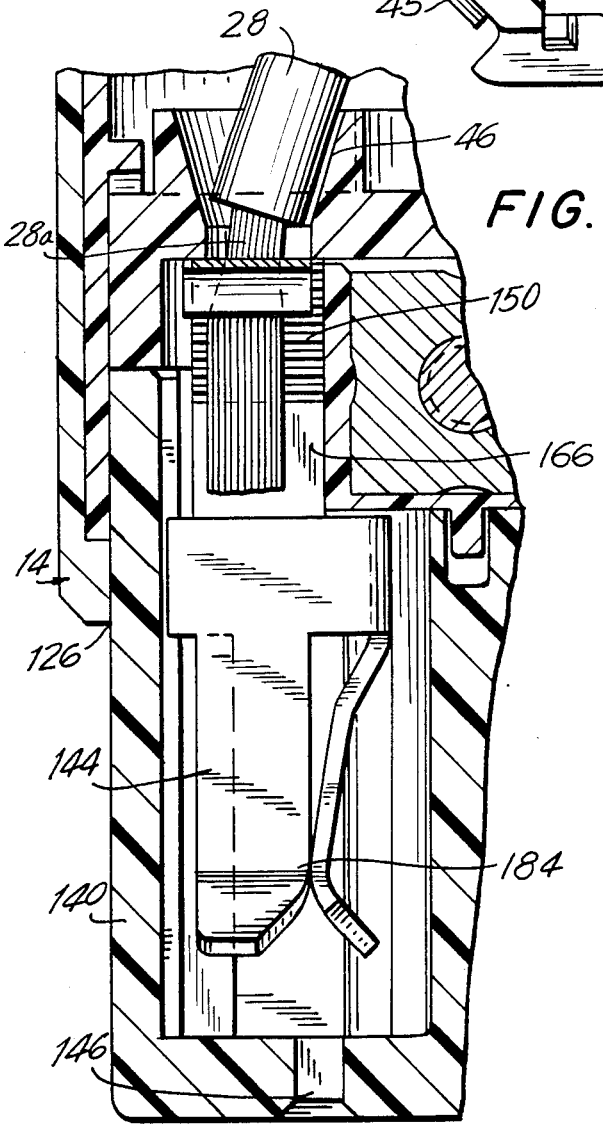
FIG. 21
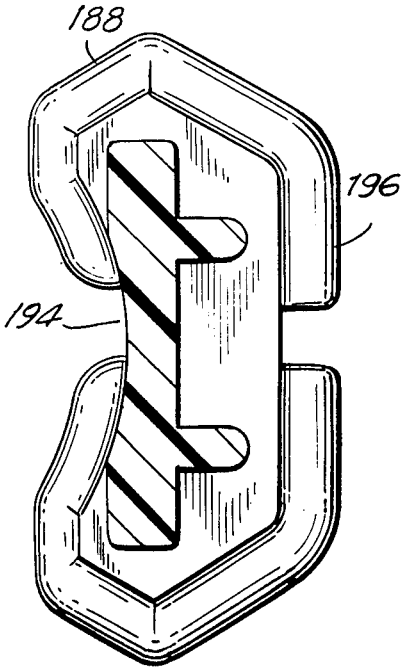
FIG. 22

WIRING DEVICE SYSTEM WITH SINGLE SCREW SUBASSEMBLY

The present invention relates generally to the art of electrical connecting devices and more particularly to an improved device for connecting the terminals of electrical conductors to either a male plug or female receptacle assembly by means of a single fastener.

Conventional plug and female receptacle connectors are provided with recesses or compartments for receiving the terminals of the electrical conductors of a wiring cable grounding conductor. Further, each of the connectors is provided with a separate screw or clamping device for achieving electrical connection between the individual conductor or wire and the terminal portion of the mating electrical contact. Generally two electrical contacts are held by the connectors assembly; three contacts are present when a grounding contact is used. The term electrical contacts as used here would mean externally protruding blades or prongs in the case of a plug or internally held receptacle contacts at the end of access recesses for male prongs in the case of a receptacle. A cable to be connected to either the plug or receptacle would first be opened to expose its individual conductors, or wires, which would then be stripped. In the case of terminal screw devices, each of the bare wires of each conductor is looped around each of the screws. Each screw is then tightened against a stop to grip the terminal of the conductor. Clamping devices likewise call for individual positioning of each conductor lead and individual adjustment of each clamping device to secure the conductor to the contact in the connector.

Other single screw devices for attaching electrical leads to a connectors are known. For example, U.S. Pat. No. 3,891,297 issued to Poliak and Lopez on April 10, 1974 discloses a type of single screw conductor attachment device. In that patent an insert is movably mounted within the body of a plug by way of a screw threadly engaged with a bushing molded or pressed into the insert. The insert has spaced cams which are positioned in opposing relation to curved free ends of spaced leaf springs. Curved free ends of the springs compressingly engage with the terminal ends of the conductors when the screw is turned and the conductors are in place for attachment.

U.S. Pat. No. 3,891,297, which has the advantage of being a single screw attachment, does have, however, several disadvantages. First, it is not inexpensive to make and assemble since it has a number of parts besides the screw and bushing, the most important being the curved springs, which also must be rockably mounted in the plug body with their free ends in opposing relation to the electrical contacts mounted in the plug. It is also noted that however tightly the insert is screwed, only a limited pressure can be exerted by the curved springs, since the insert cams do not directly press the conductor terminals against the electrical contacts in the plug, but instead the cams pressure the curved portion of the springs against the terminals. In addition, the curved portions of the springs are in contact with the conductors and, because of the elongated and unsupported curve of the springs, possible loss of resiliency in the spring (which cannot be compensated for directly by cam pressure) will result in loss of clamping pressure.

The present invention contemplates the elimination of most of these limitations and disadvantages of conventional solutions to recognized needs of the art by providing a device for attaching a multi-conductor cable to both plugs and receptacles having a novel mechanism that allows simultaneous attachment of the individual conductors by a single fastener means that provides strongly biased connections and in addition provides easier assembly with fewer parts than provided by the prior art.

Accordingly, it is an object of the present invention to provide an electrical wiring attachment device that allows a user quickly to firmly fasten two, three, or more terminals of the electrical conductors of a cable to electrical contacts in a plug or receptacle by manipulation of a single fastener.

It is a further object of the present invention to provide an electrical wiring attachment device allowing quick attachment of electrical conductors to electrical contacts in a plug or receptacle that has few parts and is easy to assemble.

It is another object of the present invention to provide a device for attaching electrical wires from a multi-conductor cable to electrical contacts in a plug or receptacle that accomplishes the task of attachment by the turning of a single screw.

It is a further object of the present invention to provide a wire attachment device that includes a carriage mounted in a plug or receptacle, the carriage being capable of being movably biased by means of manipulation of a single screw whereby electrical conductors are biasedly attached to electrical contacts mounted in the plug or receptacle.

It is a further object of the present invention to provide a wire attachment device that allows the task of attachment of electrical conductors to electrical contacts in a plug or receptacle to be accomplished by manipulation of a single fastener and further provides certain interchangable parts to be used for the assembly of both the male and female devices.

The present invention fulfills the above objects and overcomes the limitations and disadvantages of prior art solutions to problems by providing an electrical wiring device comprising an assembly mounted in a housing shell. The assembly includes electrical contacts capable of mating engagements with other electrical contacts, receiving means formed in the assembly for receiving electrical conductors, and a single fastening means for holding the electrical conductors that terminate in the assembly. The single fastener includes a movable carriage mounted within the assembly and positioned in proximity with a portion of each of the electrical contacts. A plurality of chambers are associated with the conductor receiving means. The chambers are formed between the carriage and a portion of each of the contacts. The chambers are for positioning a portion of the contacts and for receiving the terminals of the wires of the individual conductors. A single fastener, a screw fastener, is associated with the carriage and is capable of moving the carriage so as to decrease the size of the chamber and thus press the wire terminals of the conductors against the portion of the electrical contacts mounted in the chambers so as to make electrical contact. The fastener includes a nut mounted on the carriage and a flange around the screw head connected to the wall of the assembly, the screw head being accessible through a recess in the assembly wall. Thus, when the screw is rotated, the carriage is moved backward or forward relative to the assembly.

This invention will be more clearly understood from the following description of specific embodiments of the invention, together with the accompanying drawings wherein similar reference characters denote similar elements throughout the several views, and in which:

FIG. 10 is a top view of the movable carriage mounted in the plug assembly;

FIG. 11 is a side view of the carriage;

FIG. 12 is a front view of the carriage;

FIG. 13 is a perspective view of one of the biasing elements mounted on the carriage;

Figure 14A:
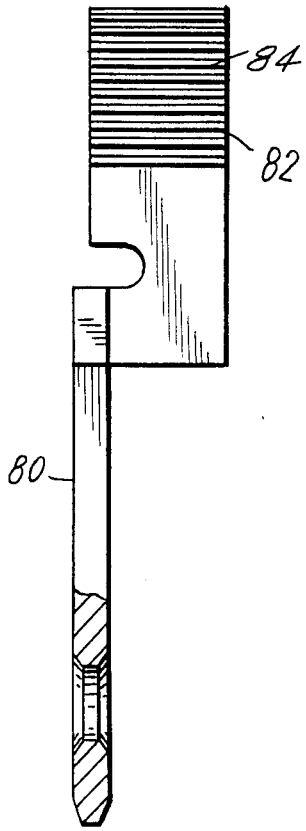
Figure 14B:
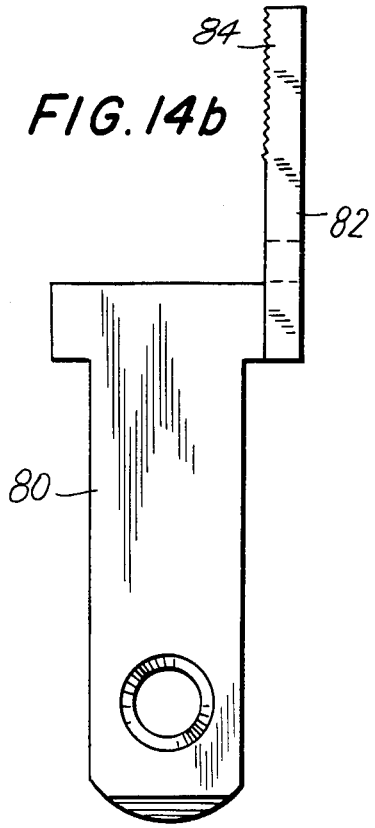

FIG. 14*a* is a side view of a blade electrical contact;

FIG. 14*b* is a side view of the blade contact shown in FIG. 14*a;*

Figure 14C:
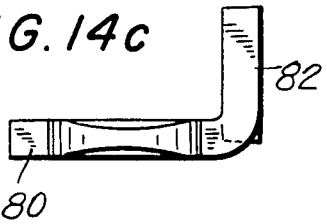

FIG. 14*c* is a top view of the blade contact shown in FIG. 14*a;*

Figure 15A:
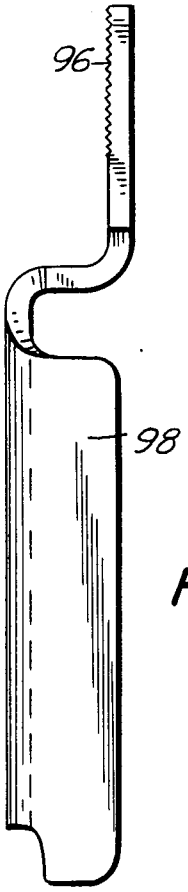
Figure 15B:
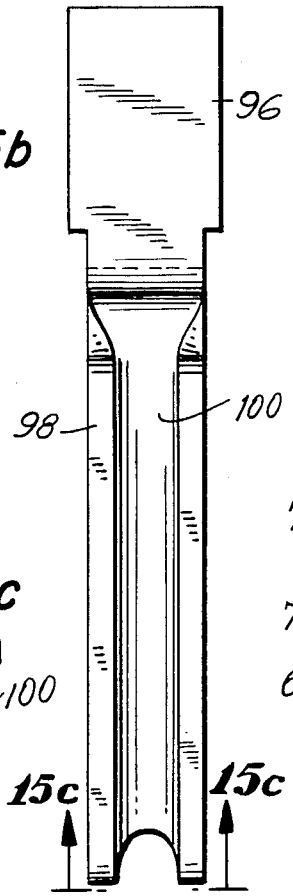

FIG. 15*a* is a side view of the ground electrical contact;

FIG. 15*b* is a front view of the ground contact shown on FIG. 15*a;*

Figure 15C:
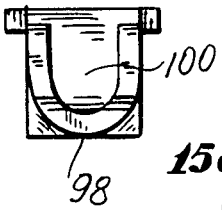

FIG. 15*c* is a bottom view of the ground contact taken along line 15*c*—15*c* in FIG. 15*b;*

Figure 16:
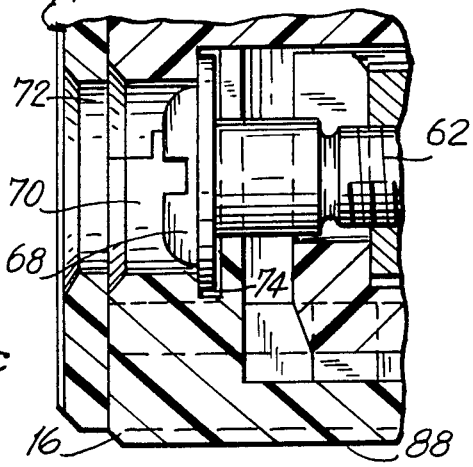
Figure 17:
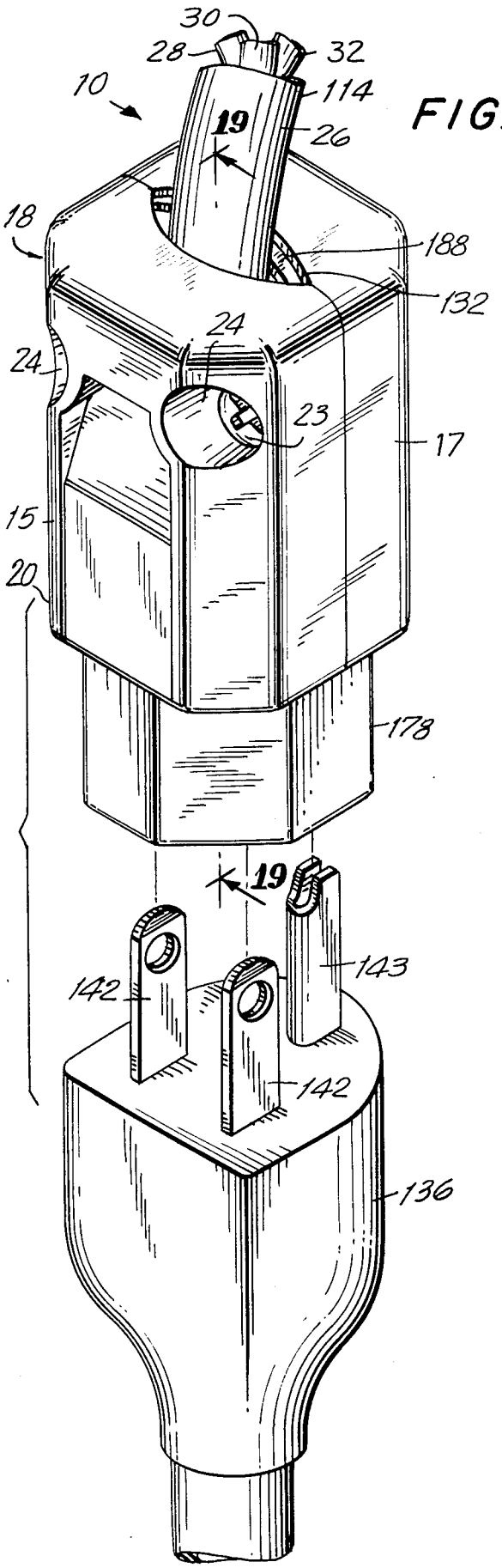
Figure 18:
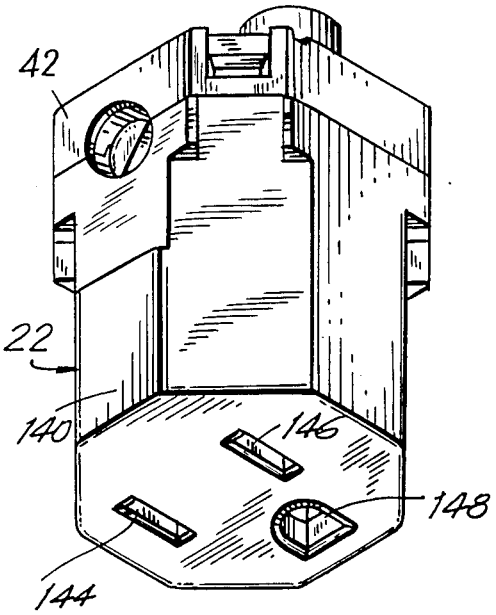
Figure 19:
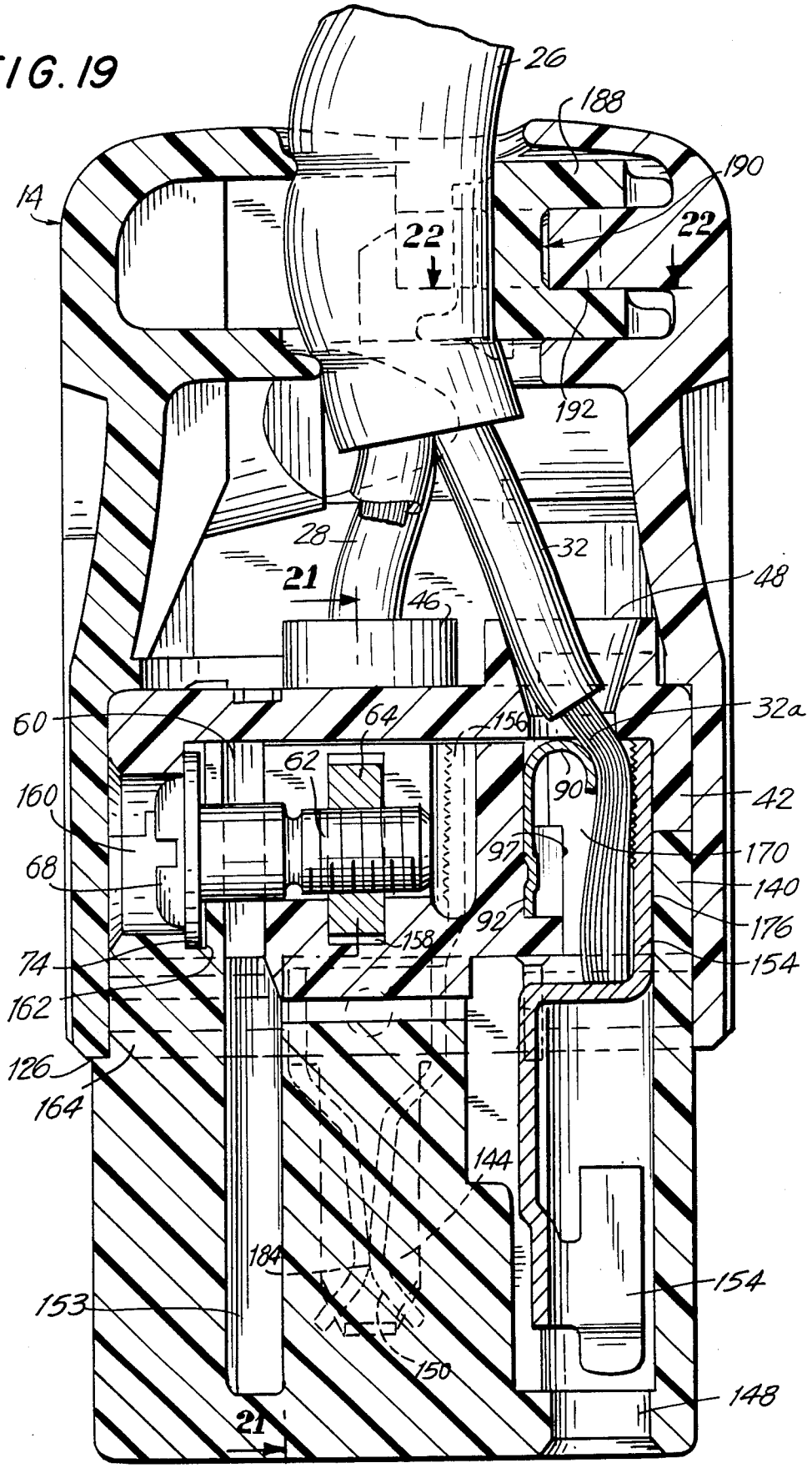

FIG. 16 is a fragmentary top view of the outer shell plug bottom, and carriage illustrating an alternative construction with an access hole through the shell to the carriage fastener screw;

FIG. 17 is a perspective view of the receptacle portion of the wiring device according to the present invention with the outer shell and electrical cord connection in place along with a conventional male plug positioned for mating with the receptacle;

FIG. 18 is a perspective view of the receptacle portion of the wiring device with its outer shell and electrical cord connection removed and showing the cover and bottom in subassembly;

FIG. 19 is a sectional view taken along line 19—19 in FIG. 17;

FIG. 20 is a top view of the receptacle bottom shown in FIG. 18;

FIG. 21 is a sectional view taken along line 21—21 in FIG. 19; and

FIG. 22 is a top view of the reversible clamp insert taken along line 22—22 in FIG. 19.

Reference is now made in more detail to the drawings. In the detailed description which follows, the terms plug or receptacle, that is, a male connector or female connector, will refer to an entire plug or receptacle including the housing shell. The term assembly, will refer to the assembly unit remaining with the housing shell removed.

Figure 1:
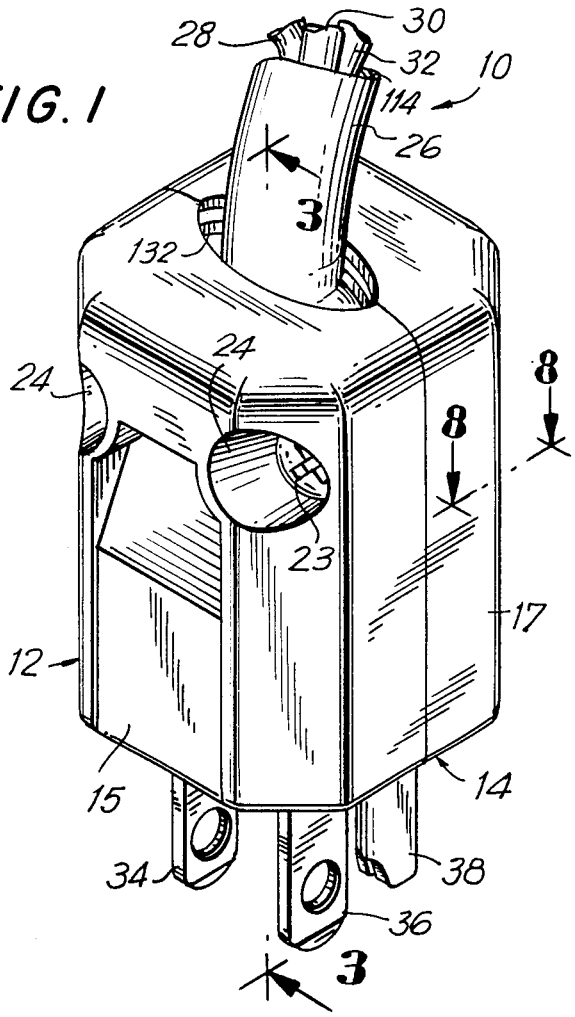
FIG. 1 is a perspective view of the plug portion of the electrical wiring device according to the present invention with the outer shell and electrical cord connection in place.
Figure 2:
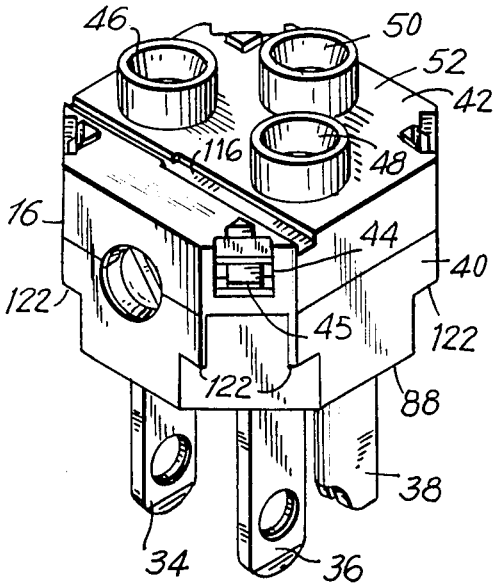
FIG. 2 is a perspective view of the plug portion of the wiring device with its outer shell and electrical cord connection removed and showing the plug cover and plug bottom in subassembly.
Figure 8:
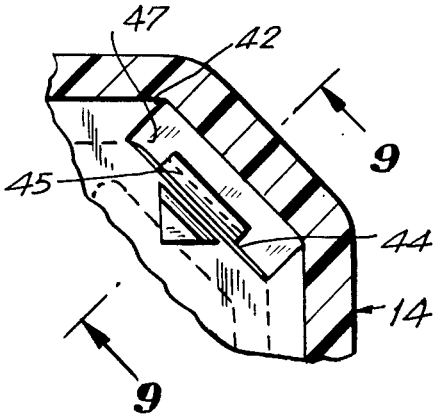
FIG. 8 is a sectional view taken along line 8—8 of FIG. 1 including a detail of a snap-on mounting of the plug cover and plug bottom.
Figure 3:
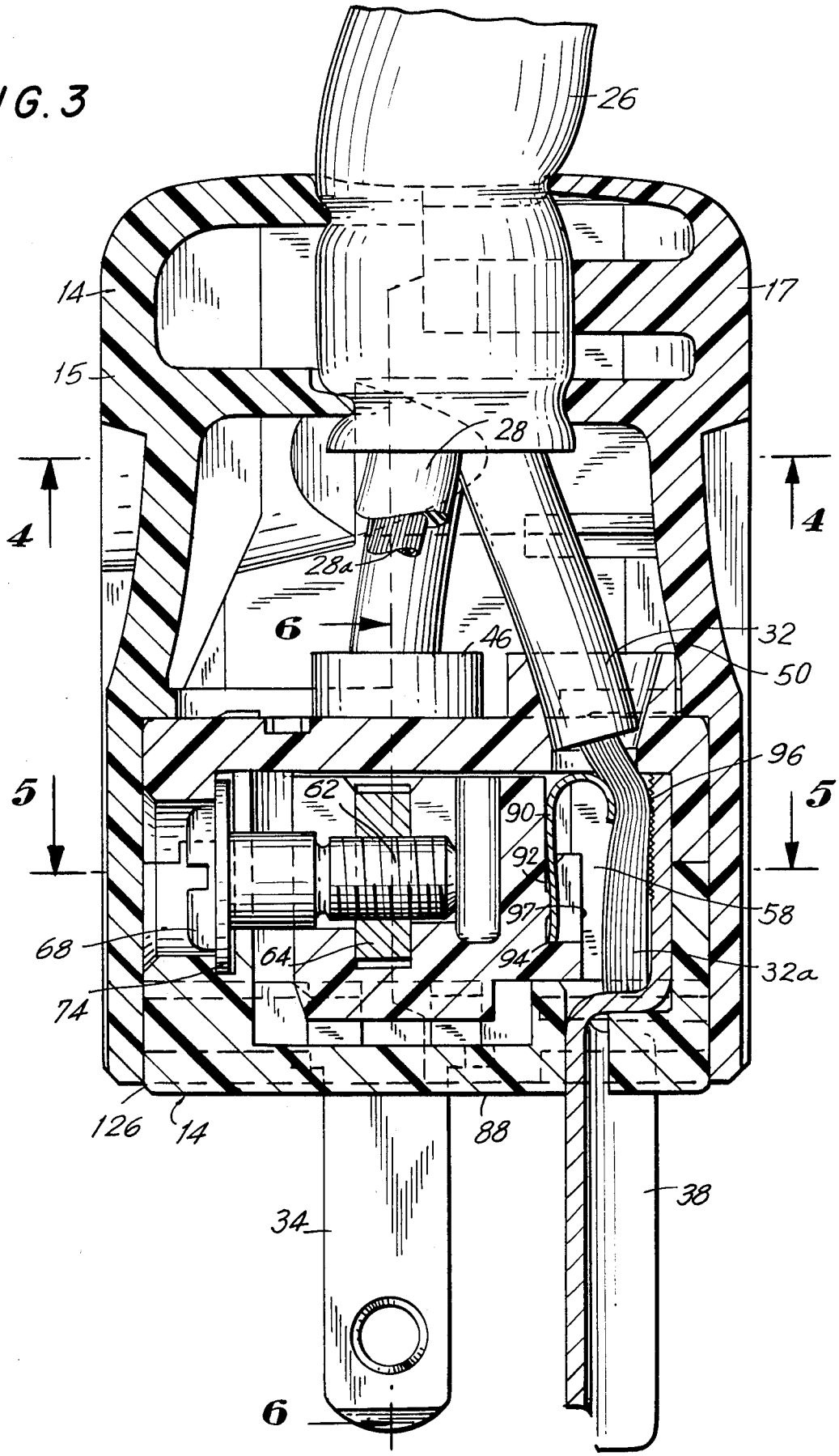
FIG. 3 is a sectional view taken along line 3—3 of FIG. 1.
Figure 4:
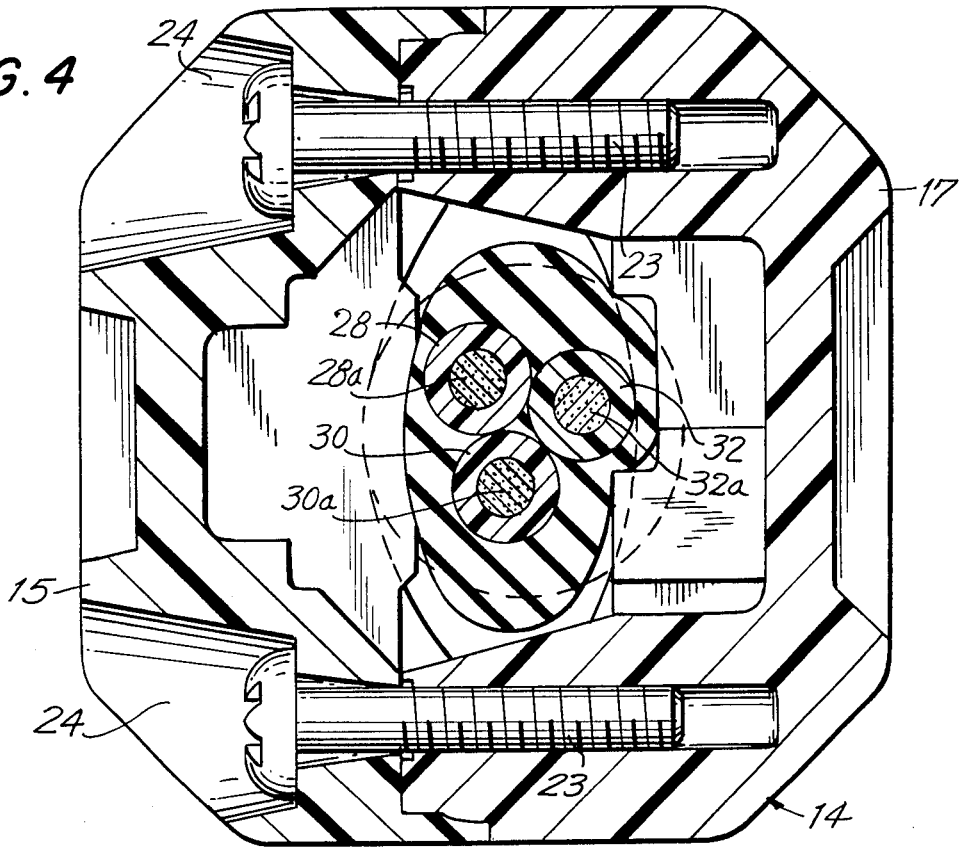
FIG. 4 is a sectional view taken along line 4—4 of FIG. 3.

FIG. 1 illustrates in a perspective view a device 10 according to the present invention. In this embodiment a male plug 12 is shown with its outer housing shell 14. FIG. 2 shows a male plug assembly 16 with the shell 14 removed. FIG. 3 illustrates a section taken through FIG. 1 indicating the assembly 16 mounted within the shell. Assembly 16 is fit mounted inside of shell 14, which in turn is formed from front and rear half-shells 15 and 17 mounted together by means of mounting screws 23 positioned in screw recesses 24. FIG. 17 illustrates a receptacle 18, which is an alternate embodiment of device 10, and receptacle assembly 22 with shell 20 removed is illustrated in FIG. 18.

Figure 5:
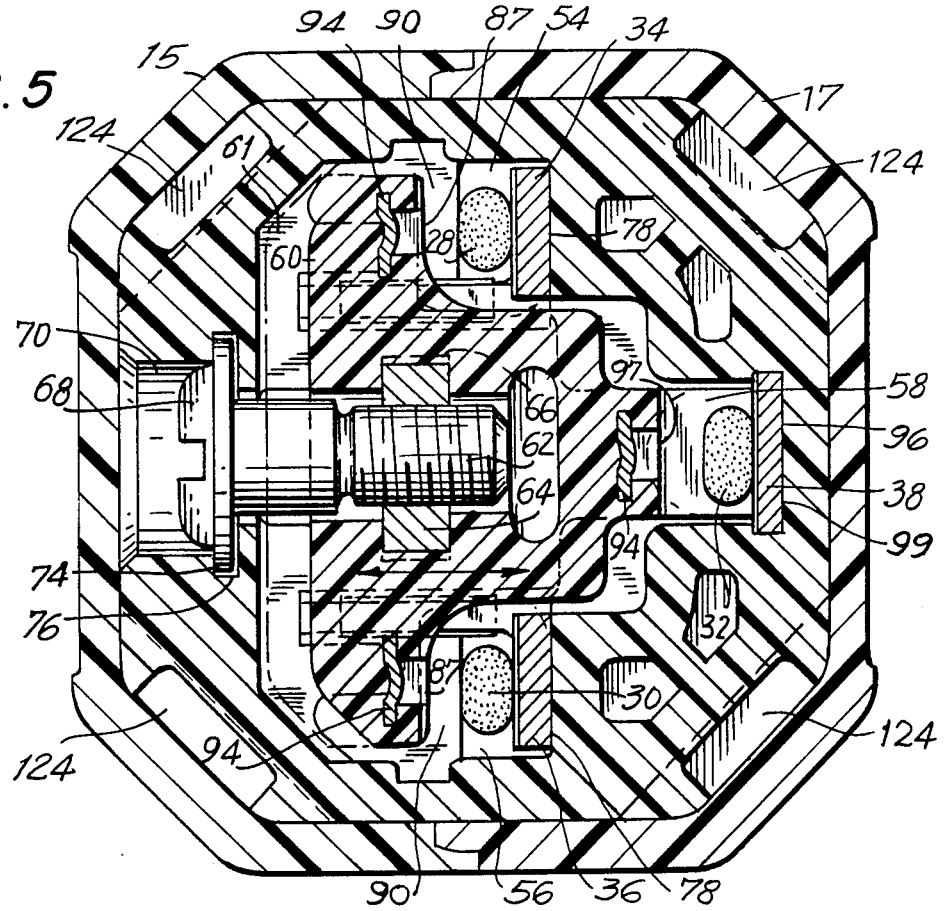
FIG. 5 is a sectional view taken along line 5—5 of FIG. 3.
Figure 6:
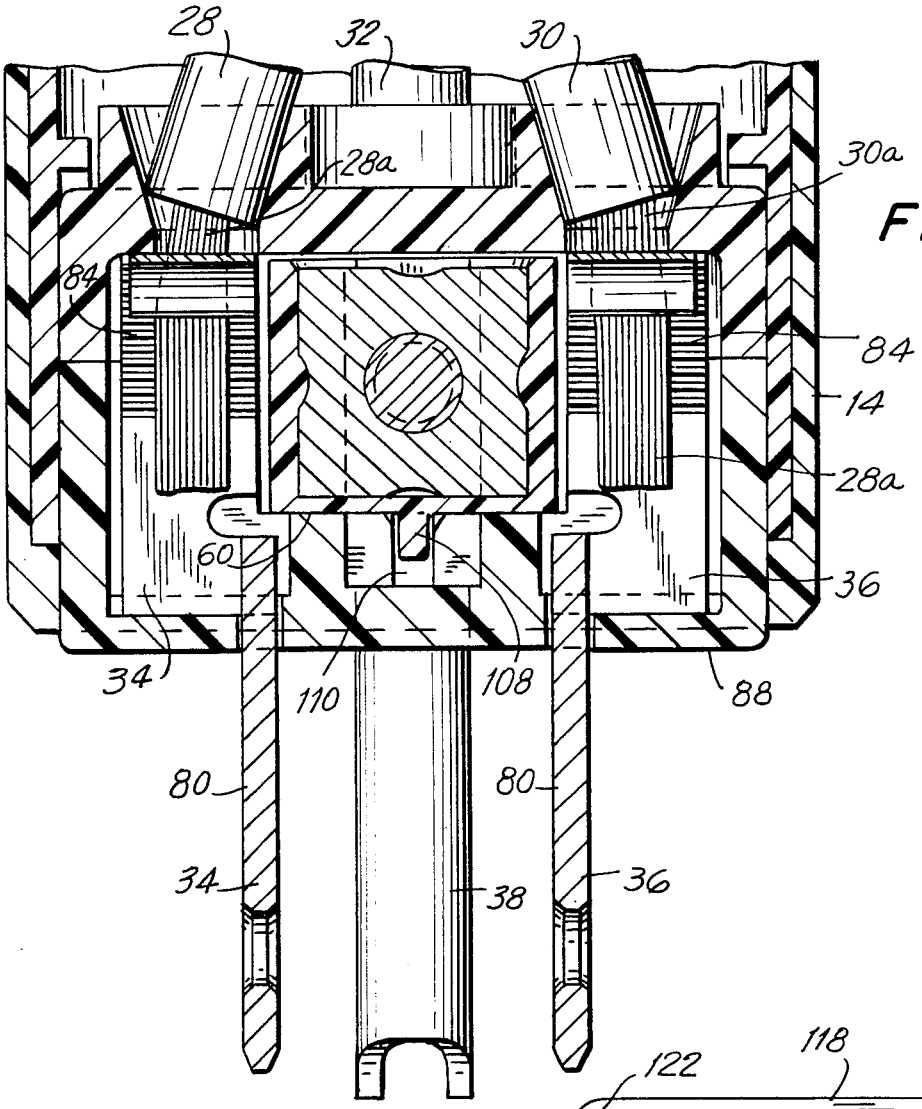
FIG. 6 is a sectional view taken along line 6—6 of FIG. 3.

Male plug assembly 16 is illustrated with multi-conductor cable 26 with individual conductors 28,30, and 32 shown in stripped perspective in FIG. 1. For purposes of illustration three conductors are shown but the invention here described can be applied to the connecting of two, four, or more electrical conductors to a male plug or receptacle. Likewise, three electrical contacts 34 and 36 along with electrical grounding contact 38, for purposes of illustration, for the invention also applies to plugs or receptacle with two, four, or more electrical contacts. FIG. 1 illustrates the three conductors in the attached mode while FIG. 2 shows plug assembly 16 with the three conductors 28,30 and 32 removed. FIGS. 5 and 6 show sectional views of FIG. 1 illustrating conductors 28, 30, and 32 in the attached mode. Conductors 28, 30, and 32 are shown with insulation and with insulation removed, that is, as bare wires, and are designated 28*a*, 28*b*, and 28*c*.

As shown in FIGS. 2, 3, and 6, male assembly 16 preferably includes an assembly bottom, or base, portion 40 and a top, or cover, portion 42. Base 40 and cover 42 are snap-fit assembled via four corner snap connection 44, with snap projections 45 on the cover having been snapped through snap recesses 47 in base 40. Cover 42 is made of resilient material. Three tapered holes, 46, 48, and 50 for receiving conductors 28, 30, and 32 are formed in top wall 52 of top portion 42. Shown in FIGS. 3 and 6, the stripped ends of electrical conductors 28 and 32 (32*a* only is shown in FIG. 3) are positioned in receiving chambers. In particular, FIG. 5 shows three receiving chambers 54, 56, and 58, with chambers 54 and 56 receiving the terminals of conductors 28 and 30 and central chamber 58 receiving the terminal of grounding conductor 38. Holes 46 and 48 are positioned over chambers 54 and 56 and hole 50 is positioned over chamber 58. Chambers 54, 56, and 58 can vary in size according to the position of movable carriage 60 which forms one of the walls of each of the chambers.

In accordance with the present invention, carriage 60 is movably mounted in carriage recess 61 within male plug 16. As shown in assembly in FIGS. 3 and 5 and in isolation in FIGS. 10, 11, 12, and a single fastener, in particular screw 62, is threadably engaged with nut 64, which in turn is engaged in a locked position in nut recess 66 formed in assembly 16. Screw 62 is positioned in screw recess 63. Screw 62 is provided with screw head 68. Screw head 68 is accessible to be rotated by a user through screw head recess 70, as shown in FIG. 5. FIG. 16 shows a detail section through assembly 16 and shell 14 that illustrates an alternative embodiment that includes a second screw head access hole 72 that extends through shell 14, whereby a user does not have to remove the shell to tighten or loosen screw 62 via screw head 68. Screw head 68 is provided with a flange 74 disposed around the perimeter of screw head 68 and that is engaged in a locked position in flange recess 76 formed within assembly 16. Flange recess 76 is formed at outer wall of assembly 16 forming a groove at access hole 72 which is capable of receiving flange 74. Thus, when screw head 68 is rotated, screw 62 is rotatably carried forward or backward in relation to nut 64 depending on the direction of rotation of head 68. In turn, nut 64 pushes or pulls carriage 60 within carriage recess 61.

Figure 7:
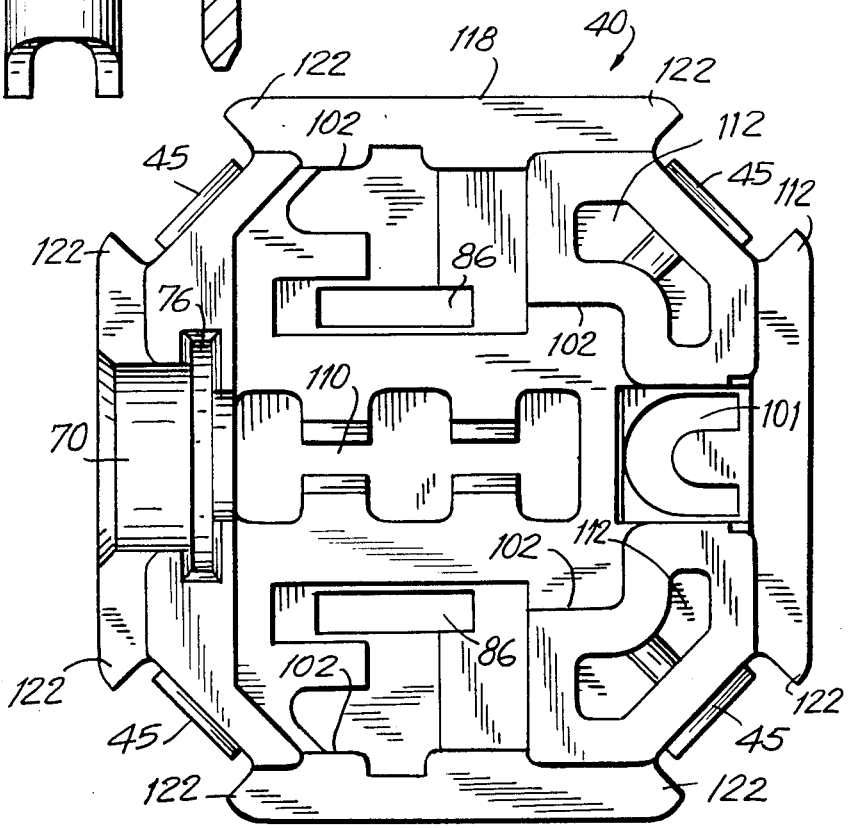
FIG. 7 is a top view of the plug bottom shown in FIG. 2.

Receiving chambers 54, 56, and 58 in assembly 16 have opposed vertical walls. Rear vertical walls 78 each have positioned on them a portion of blade contacts 34 and 36 and a portion of middle grounding contact 38. Contacts 34, 36, and 38 include conventional extended blade contact portions 80 for contacts 34 and 36, as illustrated in FIGS. 14*a*, 14*b*, and 14*c*. At right angles to blade portions 80 are enclosed mounting portions 82 with serrated flat edges 84. As shown in FIGS. 3, 5, and 6 serrated flat edges 84 are positioned against rear vertical walls 78 of the recesses 54 and 56, while blade portions 80 extend through the bottom wall 88 of assembly 16 via blade contact passages 86, most clearly seen in FIG. 3. Contact passages 86 are also shown in the top view of bottom plug portion 42 in FIG. 7. The opposed walls of chambers 54 and 56 are formed by carriage walls, or edges, 87. Middle chamber 58 is likewise formed by opposed vertical walls of the carriage and the assembly. Edge 96, shown as serrated, of grounding contact 38, shown in FIGS. 15*a*, 15*b*, and 15*c*, is positioned at assembly vertical wall 99. Semi-rounded portion 98, which forms a hollow interior 100, extends inwardly from edge 96. As shown in FIG. 7, a semi-rounded passage 101 is formed in bottom base portion 40 which is adapted to hold semi-rounded portion 98, which in turn extends downwardly beyond. bottom wall 88 of base 40 in the same manner as extended blade contact portions 80 of contacts 34 and 36 do. Edge 96 is mounted at wall 99 of middle chamber 58, and carriage wall 97 forms the opposed wall, in the same manner as do walls 87 for chambers 54 and 56.

As an aid to achieve pressured connection between the terminals of conductors 28, 30, and 32 which are positioned in chambers 54, 56, and 58 respectively, biased members 90, shown in FIG. 13, are slidably mounted above edges 87 and 96 by way of mounting tab 92, which is wedge inserted into tab inserts 94 formed between end walls 87 and 97 and the body of carriage 60. The curved portion of the member is adapted to press against the conductors before walls 87 and 97 do, thus giving bias pressure to the conductors when they are pressed against the contacts which are positioned against the opposed walls of the chambers.

When carriage 60 is moved either forward towards the chambers or backward away from the chambers, it is guided by side walls 102 of carriage guide chamber 102 formed by assembly 16. In the preferred embodiment as illustrated here, side walls 102 are formed by assembly bottom portion, 40, while the top wall of guide chamber 102 is formed by portions of top snap-on portion 42, as shown in FIGS. 3 and 6. Similarly, hold-down stops for all three contacts 34, 36, and 38 are also formed by such portions of portion 42. Carriage 60 is also aided in its movements by guide rib 108 which rides in track recess 110 formed in bottom portion 40.

In the embodiment as shown, the material used is preferably polyurethane and nylon for the device 10. It is noted that molding hollows 112 have been indicated in FIG. 7.

In operation, the sheath 114 of multi-conductor electrical cable 26 is opened and individual conductors 28, 30, and 32 to be connected to male plug 12 are separated. Shell 14 of plug 12 is opened by way of removal of the two mounting screws 19 and half-shells 15 and 17 are then removed so that male plug assembly 16 is isolated. Conductors 28, 30, and 32 are then measured at stripping gauge 116 on top wall 52 of top portion 42 of assembly 40, are cut, and then stripped of insulation to the lengths indicated by stripping guage 116. The terminal ends of the three conductors are then guided into guide passages 46, 48, and 50 leading to recesses 54, 56, and 58 respectively, with care being taken to place grounding conductor 38 into hole 50 to be guided to recess 58. When the terminal ends of the conductors are positioned in their respective recesses, screw head 68 is rotated so that screw 62 moves carriage 60 forward in the manner described previously. With this movement, carriage walls 87 and 97 are moved forward toward opposed contact areas 84 of contacts 34 and 36 and contact area 96 of grounding contact 38 until the conductors 28, 30, and 32 are tightly pressed into electrical connection with the respective contacts 34, 36, and 38. This is accomplished with the aid of the three carriage biasing springs 90 that extend directly above walls 87 and 97 of the carriage. When connection is accomplished, shell 14 is reassembled around plug assembly 14.

Figure 9:
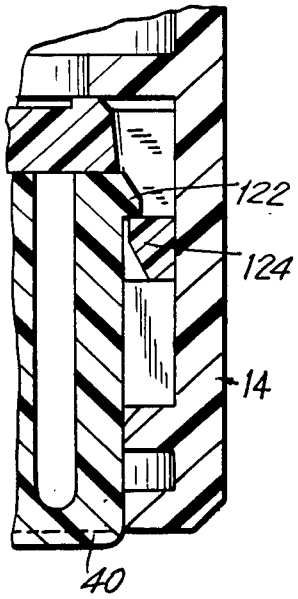
FIG. 9 is a sectional view taken along line 9—9 of FIG. 8.

Male plug shell 14 is adapted to fit around assembly 16 as shown in FIGS. 1, 3, 4, 5, and 6. Assembly 16, when viewed from either top or bottom, has outer walls 118 preferably shaped in the form of an octagon; while inner walls of housing shell 14 are likewise generally octagonal in shape and adapted to fit snugly around walls 118 of the assembly so as to hold the assembly firmly in position without the assembly being able to rotate. In addition, bottom portion 40 of the assembly is provided with four cornered double tab extensions 122 that are adapted to fit over four mating cornered stop tabs 124 that extend inwardly from the walls of shell 14. Tabs 124 prevent assembly 16 from passing through bottom apparatus 126 formed by the shell. Bottom apparatus 126 is indicated in FIGS. 3 and 6. Tab extentions 122 and stop tabs 124 are illustrated in FIG. 9 and tab extentions 122 in FIG. 7. FIGS. 7 and 9 also illustrate upwardly extending rear mounting extentions and forward mounting extentions, which project into pressured alignment with the bottom wall of cover portion 42 as indicated in FIGS. 3, 6, and 9.

As shown in FIG. 1, housing shell 14 forms upper aperature 132 which acts as a passage for conductor cable 26 to plug assembly 16. Upper aperature 132 is formed equally by front and rear housing half shells 15 and 17 and receives cable 26 for passing into shell 14 where the individual conductors are split and passed through conductor holes 46, 48, and 50 to recesses 54, 56, and 58. Top wall 52 of cover 42 of assembly 16 is in pressing alignment with an inner blocking flange of shell 14 which extends around the inner periphery of the shell. Thus, assembly 16 is kept wedged inside of shell 14. The assembly is kept from moving upwards or downwards in the shell and the octagonal configuration of the inner wall of the shell and the outer wall of the assembly prevents rotation of the assembly relative to the shell.

FIG. 17 illustrates an embodiment of the present invention where device 10 is female receptacle 18 showing multi-conductor cable 26 entering upper shell aperature 132 of plug shell 20. The shell for male plug 12 and female receptacle 18 are interchangeable for use to house either the plugs or receptacle assemblies. FIG. 17 also shows a conventional male plug 136 in position for mating with receptacle 18. FIG. 18 illustrates receptacle assembly 22 in isolation with its shell 14 and cable 26 removed. Receptacle assembly 22 includes lower base, or bottom portion 140 and top, or cover, portion 42, which is identical with cover 42 of the male assembly 16. Base 140 is larger than base 40 of the male assembly since, as will be discussed, the electrical contacts are contained in the base 140, and in addition, access passages 144, 146, and 148 passing male contacts, such as blade contacts 142 and grounding contact 143, of plug 136 to the female electrical contacts, are also contained in the base 140. Thus, as can be seen in FIG. 17, base 140 extends through and beyond shell bottom aperature 126(FIG. 19).

Receptacle contacts 150 and receptacle grounding contact 154 are illustrated in FIGS. 19 and 21. These receptacle contacts are completely contained within the receptacle plug assembly 22. Access passages 144, 146, and 148 are formed within assembly 22. When male contacts enter the access passages, electrical contact is made with the conventional female contacts, shown with receptacle grips. FIG. 19 shows molding hollow 153.

As in the plug assembly, multi-conductor cable 26 passes through upper aperature 132 and individual conductors enter the tapered holes 46, 48, and 50 of assembly 22 formed in cover 42.

Carriage 60, which is the same as carriage 60 mounted in plug assembly, is movably mounted in carriage recess 156 in assembly 22 in the same manner as carriage 60 is provided with the same screw 62, which is threadably engaged with nut 64, which in turn is engaged in a locked position in nut recess 158 in assembly 16. Screw 62 is provided with screw head 68, which is accessible to be rotated by a user through screw head recess 160, as shown on FIGS. 18 and 19. Screw head 68 is also provided with a flange 74 that is engaged in a lock position in flange recess 162 formed at outer wall 164 of assembly 22. Thus, when screw head 68 is rotated, screw 62 is rotatably carried forward or rearward in relation to nut 64, depending on the direction of rotation of screw head 68. In turn, nut 64 pushes or pulls carriage 60 within carriage recess 156. Analagous to chambers 54, 56, and 58 in assembly 16 are chambers 166, for the two conventional contacts and conductors and 170 for the grounding contact and conductor. Chambers 166 and 170 are for receiving the terminals of the three conductors of cable 26, which are designated as conductors 28 and 30 and grounding conductor 32 as in the description of male plug 12. Conductors 28, 30, and 32 enter assembly 22 through tapered holes 46, 48, and 50 respectively of cover 42 and their wire terminals **28*a*, 30*a*, and 32*a* are passed to chambers 166 and 170 respectively. Chambers 166 and 170 are formed between the two walls 87 and wall 97 of carriage 60 and opposed walls 176 of assembly 22. Walls 176 of assembly 22 are analagous to walls 78 and 99 of male assembly 16. When carriage 60 is moved inwards towards walls 176, chambers 166 and 170** become smaller.

Portions of receptacle contacts 150, 152, and 154 are positioned within assembly 22 and specifically within assembly base 140 so that contact portions are positioned against walls 176 of the assembly, specifically of the base. As carriage 60 presses the terminals of the conductors inwards into pressing connection with the contacts in the chambers, electrical connection is made.

Carriage 60 is also provided with bias spring elements 90, which are mounted at the contact walls of carriage 60.

Although the operation of a single screw to press conductors into electrical connection with electrical contacts are the same for both plugs and receptacle, the necessity of enclosing the receptacle contacts within receptacle base 140 makes necessary the elongation of base 140 as shown in FIG. 20. Lower aperature 126 of shell 20 is adapted to pass the elongated portion 178(FIG. 17). In other respects, receptacle base 140 is directly analagous to plug base 40, as is illustrated in the top view of base portion 140 in FIG. 20. Base 140 has two contact passages and one grounding contact passage that are larger than the analagous passages of male base 40 because of the configuration of conventional female contacts 150 and 154, which have conventional three-way grippers for receiving the male blade contacts. The gripper 184 is shown in FIGS. 19 and 21. The configuration of track recess 186 is also shown in FIG. 20. The eight bottom tab extentions 122 on base 140 are the same as for male base 40 as are the other configurations for mounting base 140 with cover 42 to shell 14.

FIG. 22 illustrates a clamp 188 that is mountable on shell 20, specifically on rear half-shell 17, at upper aperature 132 of the shell. Clamp 188 is shown in mounted position in FIGS. 1, 3, 17, and 19. As shown in these figures, one for the plug; the other for the receptacle, clamp 188 has a mounting groove 190 (FIG. 19) formed around its perimeter that fits over a raised rib 192 at the top of rear half-shell 17. Clamp 188 is configured with a concave portion 194 and a straight portion 196. Clamp 188 is reversible and can be mounted with either concave portion 194 or straight portion 196 extending into aperature 132. Clamp 188 serves to wedge cable 26 into aperature 132. When the cable is small, clamp 188 is positioned to place straight side 196 in the aperature; and when the cable is large, clamp 188 is reversed so as to have concave portion 194 extend into the aperature, thus reducing the aperature in size in the former position and extending the aperatus size relative to the former position in the latter position. This allows gripping control over various sized cables.

The male and female members of the present invention in the embodiments described use the same shell, assembly cover, and carriage, which interchangeably allows reduced manufacturing costs. The invention description uses three-conductor plugs for purposes of illustration, and plugs of two four, or more conductors could of course have been described within the spirit of the invention. Various departures from the embodiments described also fall within the scope of this invention. For example, the assembly can be adapted to conform to contacts of different configurations from those described. Other embodiments, forms, and modifications of the invention coming within the proper scope of the appended claims will, of course, readily suggest themselves to those skilled in the art.

We claim:

1. An electrical wiring device comprising in combination:

a housing shell, an assembly carried by said shell, said assembly including electrical contacts capable of mating engagement with other electrical contacts, receiving means formed in said assembly for receiving electrical conductors having terminals, and single fastener means for holding said electrical conductors which terminate in said assembly, said single fastener means including movable means mounted within said assembly and positioned in proximity with a portion of each of said electrical contacts, chamber means associated with said receiving means, said chamber means being formed between said movable means and said portion of each of said contacts, said chamber means being for positioning said portion of said contacts and for receiving the terminals of said conductors, and a single fastener associated with said movable means capable of moving said movable means, said movable means being for biasing said terminals of said conductors into electrical connection with said contacts at said chamber means upon manipulation of said single fastener, said movable means including a carriage slidably mounted within said assembly, said single fastener means including a nut engaged with said carriage having threads disposed approximately at right angles to the direction of movement of said carriage, a screw engaged within said nut having a screw head, said assembly forming an access hole in an outer wall of said assembly dimensioned to receive a screw head, and stop means connected to said screw and engaged with said assembly, said stop means being for preventing movement of said screw relative to said assembly when said screw is rotated at said screw head.

2. The device according to claim 1, wherein said assembly includes a plurality of electrical contacts and said receiving means receives a matching plurality of electrical conductors and wherein said chamber means includes a plurality of chambers for holding said plurality of contacts and for receiving said plurality of conductors.

3. The device according to claim 2, wherein said plurality of contacts and conductors is three, including one grounding contact and one grounding conductor.

4. The device according to claim 2, wherein said plurality of contacts and of conductors is two.

5. The device according to claim 2, wherein said stop means includes a flange disposed around the perimeter of said screw head, said outer wall of said assembly forming a groove at said access hole capable of receiving said flange, said flange being engaged in said groove, whereby when the screw is rotated, the flange prevents the screw from being moved relative to the assembly.

6. The device according to claim 5, further including biasing means mounted upon said carriage for aiding in the pressing of said terminals of said conductors into electrical connection with said electrical contacts, said biasing means including a plurality of biasing members mounted upon said carriage at each of said plurality of recesses, said members having biased curved portions capable of being in pressure contact with said terminals of said conductors at said plurality of chambers and further having mounting tabs, said carriage forming a plurality of tab recesses capable if receiving said mounting tabs.

7. The device according to claim 6, wherein said assembly includes a body, a cover, and connecting means for connecting said cover to said body, said connecting means being a plurality of snap-on connecting means formed on said body and said cover.

8. The device of claim 7, wherein said assembly is a plug assembly wherein said electrical contacts include blade portions that extend beyond a bottom wall of said body of said assembly and said receiving means for receiving said conductors are receiving holes formed on the cover of said assembly.

9. The device of claim 7, wherein said assembly is a receptacle assembly wherein said electrical contacts that are disposed within said assembly form access passages to each of said contacts, said access passages being adapted to pass said blade portions of said plug assembly into mating electrical engagement with said contacts of said receptacle assembly.

10. The device according to claim 9, wherein the cover of a male plug assembly is interchangeable with the cover of a receptacle assembly.

11. The device according to claim 10, wherein the housing shell of said male plug assembly is interchangeable with the housing shell of a receptacle assembly.

12. The device according to claim 11, wherein said device is made of electrically insulative material, said material being a plastic, said plastic being polyurethane.

* * * * *